United States Patent [19]

Genno

[11] Patent Number: 5,052,836

[45] Date of Patent: Oct. 1, 1991

[54] PRINTER

[75] Inventor: Hirokazu Genno, Hirakata, Japan

[73] Assignee: Sanyo Electric Co., Ltd., Osaka, Japan

[21] Appl. No.: 451,368

[22] Filed: Dec. 15, 1989

[30] Foreign Application Priority Data

Dec. 20, 1988 [JP] Japan ..... 63-321067

[51] Int. Cl.[5] ..... B41J 11/58

[52] U.S. Cl. ..... 400/629; 400/636; 400/120; 271/122

[58] Field of Search ..... 400/636, 120, 624, 625, 400/629; 271/122, 36, 163, 119, 117, 127

[56] References Cited

U.S. PATENT DOCUMENTS

| | | | |
|---|---|---|---|
| 3,044,770 | 7/1962 | Breuers | 271/122 |
| 4,785,688 | 11/1988 | Shiozaki et al. . | |
| 4,861,013 | 8/1989 | Shibata et al. | 271/119 |

FOREIGN PATENT DOCUMENTS

| | | | |
|---|---|---|---|
| 373500 | 3/1920 | Fed. Rep. of Germany | 271/119 |
| 1074778 | 10/1954 | France | 271/122 |
| 0033262 | 3/1977 | Japan | 271/122 |
| 0098445 | 6/1982 | Japan | 271/122 |
| 59-64442 | 4/1984 | Japan . | |
| 0141576 | 7/1985 | Japan | 400/636 |
| 0326581 | 12/1957 | Switzerland | 271/122 |

*Primary Examiner*—Eugene H. Eickholt
*Attorney, Agent, or Firm*—Darby & Darby

[57] ABSTRACT

A printer wherein a piece of recording paper housed in a cassette is picked up and sent to a platen roller which is made to rotate in the direction of leading the sent recording paper to the printing position, hereupon one piece of recording paper to be sent to the printing position is separated from the other pieces, the latter pieces being sent back in the reverse direction to the printing position, by rotating a separation roller positioned against the platen roller in the same direction as that of the platen roller rotation.

12 Claims, 4 Drawing Sheets

PRINTER

BACKGROUND OF THE INVENTION

1. Field of the Invention

This invention relates to a printer provided with a paper-feeding mechanism which feeds recording paper one by one piled in a cassette.

2. Description of Related Art

As a printer of delivering piled recording paper one by one, for example, a printer with a paper feeding unit separating paper with friction rollers is disclosed in Japanese Patent Application Laid-Open No. 59-6442 (1984). As shown in FIG. 1, the printer is provided with a pick up roller 14 which presses on the upper surface of the recording paper piled on a sheet loading plate 19 on a paper-feeding cassette 18 for sending out the uppermost recording paper 20 by rotating correspondingly to a feeding signal, a feed roller 33 which rotates downstream in the feeding direction installed downstream of the feeding direction, and a separation roller 13 which presses on the feed roller 33 with the recording paper passing between them and rotates in the direction of pushing back the recording paper 20. The paper feeding unit is so constructed as to separate one piece of paper to feed due to the difference of coefficients of friction by selecting material of the rollers where the coefficients of friction between the feed roller 33 and the paper, the separation roller 13 and the paper, and one piece of paper and another being respectively represented by $\mu f$, $\mu s$ and $\mu p$, satisfy the following inequality;

$$\mu f > \mu s > \mu p$$

A conventional paper feeding mechanism feeds paper by three rollers, that is, a pick up roller 14 for picking up the recording paper 20 from the paper-feeding cassette 18, a feed roller 33 provided at a downstream side of the pick up roller 14 and sends the recording paper 20 to the body of the recording apparatus, and a separation roller 13 for preventing plural pieces of recording paper 20 being sent at a time. This paper feeding mechanism, however, is independent from the recording apparatus, so that a guide mechanism for guiding the recording paper 20 to the body mechanism is required, resulting in being an obstacle to make the apparatus small-sized.

SUMMARY OF THE INVENTION

The present invention has been devised to solve the problem above mentioned.

The primary object of the invention is to provide a printer having less number of parts by providing a separation roller at a position opposite to a platen roller which supports recording paper at a position opposite to a printing head, thereby the recording paper to be sent between the platen roller and the separation roller from a cassette, is sent to the printing position by the platen roller without a feed roller.

The second object of the present invention is to provide a small-sized printer having a paper-feeding mechanism in the vicinity of a printing mechanism by providing a separation roller at a position opposite to a platen roller which supports recording paper at a position opposite to a printing head, thereby the recording paper to be sent between the platen roller and the separation roller, is sent to the printing position.

The above and further objects and features of the invention will more fully be apparent from the following detailed description with accompanying drawings.

DESCRIPTION OF THE PREFERRED EMBODIMENTS

In the following, explanation will be made on an embodiment of the invention referring to FIGS. 2 through 4.

Figure 1:
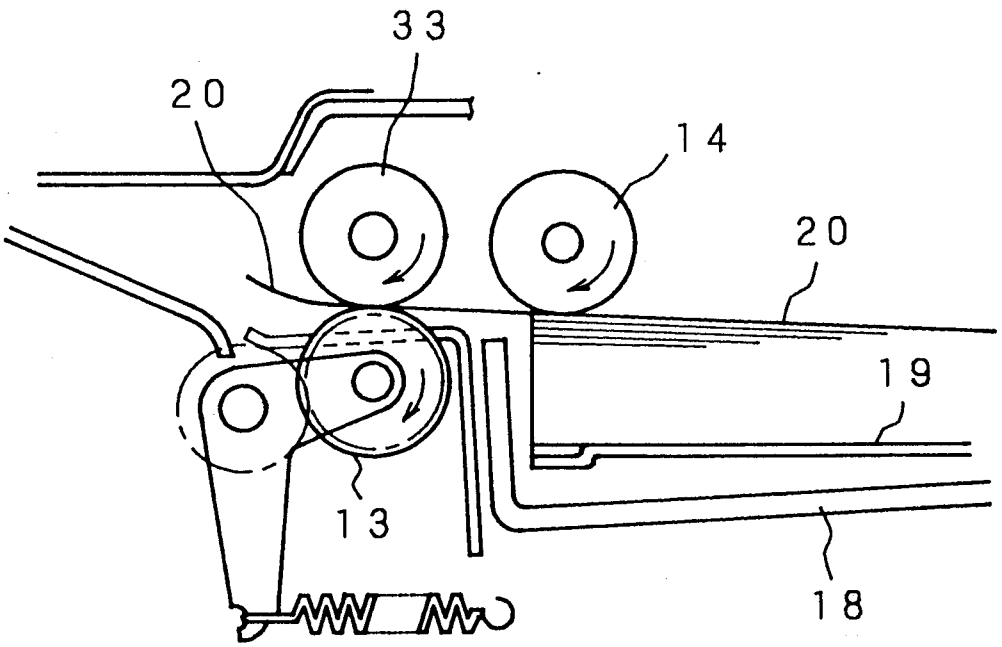
Fig. 1 Prior Art
FIG. 1 is a side view showing a construction of a conventional paper-feeding mechanism.
Figure 2:
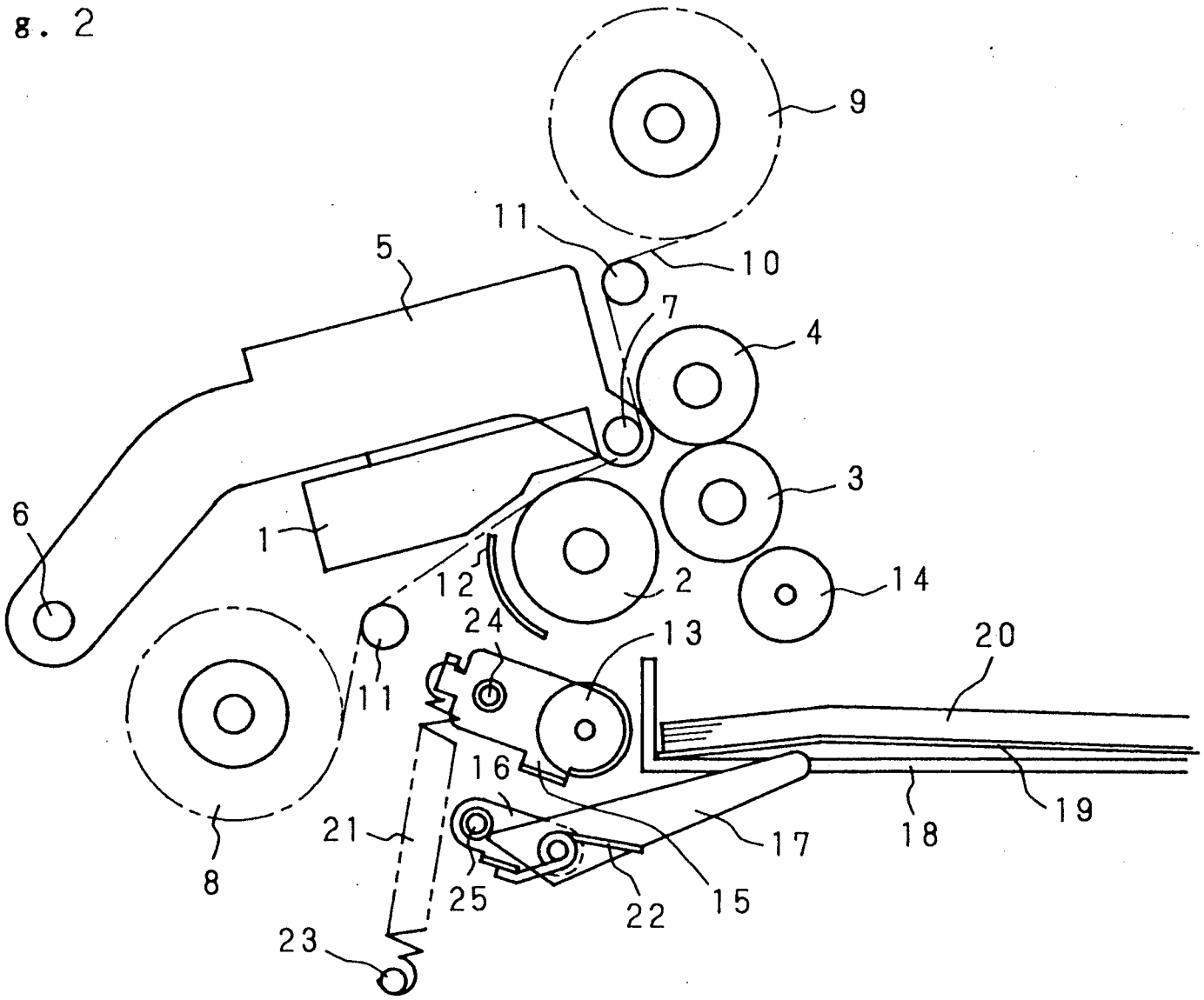
FIG. 2, FIG. 3 and FIG. 4 are side views showing a construction of a thermal transfer printer related to the invention, which respectively indicate the states of waiting, feeding the paper, and sending back the recording paper.

FIG. 2 is a side view showing a construction of a thermal transfer printer related to the invention, in the state of waiting. A paper-feeding cassette 18 is detachable, and a thermal head 1 is separated from the platen roller 2 by an angle of about three degrees. In the paper-feeding cassette 18, the recording paper 20 is piled on a sheet loading plate 19 whose bottom is pushed by a knock up arm 17. An ink sheet 10 drawn out of an ink sheet roll 8 passes between the thermal head 1 and the platen roller 2, is guided by guide shafts 7 and 11, and is rolled around a winding roller 9.

The thermal head 1 is fixed to a thermal head supporting plate 5. The thermal head supporting plate 5 is supported rotatable by the rotational axis 6, to the body mechanism, and the thermal head 1 is attachable to the platen roller 2. The separation roller 13 is disposed movable toward and away from the platen roller 2. This separation roller 13 is given constant torque in the same direction as that of the platen roller 2 rotation through a torque limitter, thereby pushing back the recording paper 20 except the necessary one. That is, the platen roller 2 and the separation roller 13 work together to prevent plural pieces of recording paper being sent at a time. A torque limiter for a paper feeding device of an office machine is known from U.S. Pat. No. 4,785,688.

A capstan roller 3 and a capstan pressure roller 4 are provided at the downstream from the contact point of the platen roller 2 with the thermal head 1, and the recording paper 20 is inserted between the both rollers 3, 4, then the recording paper 20 is carried by the rotation of the capstan roller 3.

Next, the operation of the embodiment of the invention will be explained according to FIG. 3 and FIG. 4. FIG. 3 is a side view showing a construction of the thermal transfer printer in the state of feeding recording paper. FIG. 4 is a side view showing a construction of the printer in the state of sending back recording paper.

When a paper feeding signal is inputted, a rotary shaft 25 of a knock up bracket 16 is rotated counterclockwise by a motor not shown, thereby the knock up bracket 16 and a spring 22 of the knock up arm 17 are rotated in the same way to rotate the knock up arm 17.

The rotating knock up arm 17 lifts the sheet loading plate 19 and the recording paper 20, to contact the recording paper 20 with the pick up roller 14. At this time, a spring 22 gives the press force to the recording paper 20 against the pick up roller 14.

A rotary shaft 24 of a separation roller bracket 15 is rotated counterclockwise by a motor not shown to contact the separation roller 13 with the platen roller 2.

At this time, a spring 21 gives the pressure to the separation roller 13 against the platen roller 2.

Figure 3:
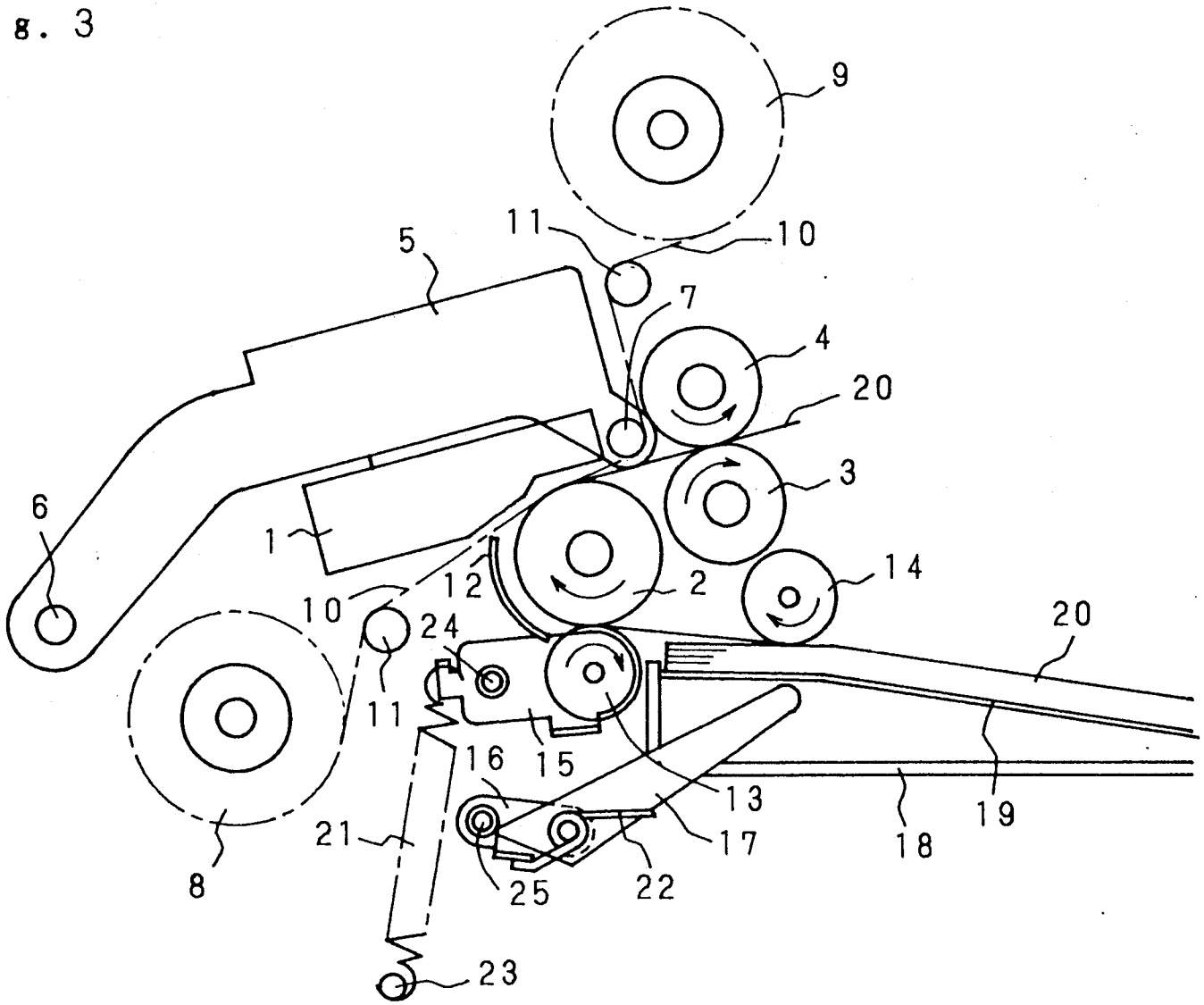

The pick up roller 14, the platen roller 2, and the separation roller 13 rotate respectively in the direction of arrows shown in FIG. 3, thereby the recording paper 20 being fed. When only one piece of recording paper 20 is fed, the separation roller 13 rotates in the reverse direction of the arrow in the figure due to working of torque limitter. When plural pieces of recording paper is fed, the separation roller 13 pushes back the recording paper 20 to the paper-feeding cassette 18 until the uppermost one is left.

In this way, only one piece of recording paper 20 is fed, due to the rotation of the platen roller 2, the recording paper 20 is guided with a paper guide 12, the ink sheet 10, and the thermal head 1 by the rotation of the platen roller 2, between the capstan roller 3 and the capstan ressure roller 4.

Next, the thermal head 1 presses on the recording paper 20, the knock up bracket rotary shaft 25 rotates clockwise, then the sheet loading plate 19 and the recording paper 20 go down. In this state, printing is carried out, while the recording paper 20 is carried by the capstan roller 3 and the platen roller 2 becomes rotatable without a driving source not shown. In addition, the separation roller 13 is made to rotate clockwise.

Accordingly, the tension between the platen roller 2 and the capstan roller 3 can be maintained properly by the pressure of the thermal head 1 and the pressure of the separation roller 13. In this embodiment the separation roller 13 is rotated clockwise to pull the recording paper 20 by torque applied by the torque limitter not shown, however, the same effect can be gained when the separation roller 13 is locked.

In monochrome printing, it is enough to release the thermal head 1 at an angle of about three degrees and to rotate the capstan roller 3 clockwise to discharge paper.

Figure 4:
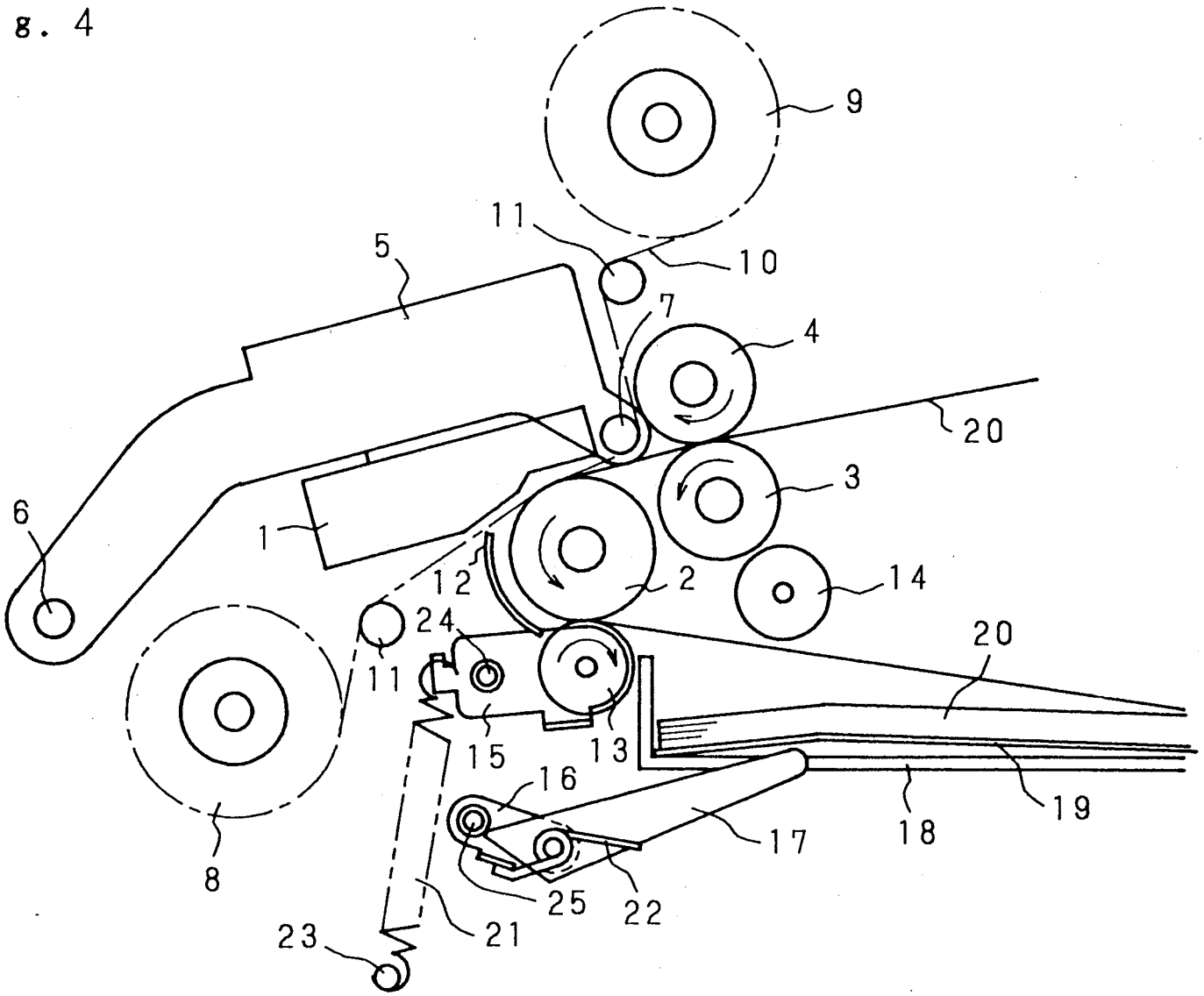

In color printing, when finishing every color printing, it is necessary to release the thermal head 1 at an angle of about three degrees as shown in FIG. 4, to send back the recording paper 20.

It is carried out by rotating the capstan roller 3, the platen roller 2, and the separation roller 13 in the direction shown by arrows in FIG. 4. In this step, the same effect as above can be obtained when either the platen roller 2 or the separation roller 13 is driven.

The color printing is achieved by repeating abovementioned operation. When the paper is discharged, a rotary shaft 24 of the separation roller bracket 15 rotates clockwise to release the separation roller 13 from the platen roller 2.

At this time, printing sequence is finished, and the printer returns to the state of waiting shown in FIG. 2.

In addition, this embodiment refers to a thermal transfer printer, however, the embodiment is not limited to this, but also applicable to any printer and the same effect can be gained as the embodiment.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the meets and bounds of the claims, or equivalence of such meets and bounds thereof are therefore intended to be embraced by the claims.

What is claimed is:

1. A method of printing, comprising the steps of:
housing recording paper as a pile of sheets;
picking up one sheet of recording paper and sending the sheet to a platen roller;
conveying the sent sheet of paper to a printing position which is between a printing head and the platen roller by rotating the platen roller in a direction;
separating the one sheet of paper to be sent to the printing position from the rest of the paper in the pile by rotating a separation roller in the same direction as that of the platen roller; and
sending back the other sheets away from the printing position by rotating the separation roller in a reverse direction.

2. A method as in claim 1, further comprising the step of moving the separation roller toward and away from the platen rol[1]-r.

3. A method as in claim 1, further comprising the step of giving the separation roller a constant torque in the same direction as the direction of rotation of said platen roller during the step of separating and rotating the separation roller in the reverse direction relative to the direction of rotation of the platen roller during the step of conveying of the one sheet of recording paper to said printing position.

4. A method as in claim 1, further comprising the step of biasing the separation roller in a direction against said platen roller.

5. A method as in claim 1, further comprising pressing paper between on said platen roller between said printing head and said platen roller.

6. A printer as in claim 5, further comprising the step of giving the separation roller a constant torque in the same direction as the direction of rotation of said platen roller during the step of separating and rotating the separation roller in the reverse direction relative to the direction of rotation of the platen roller during the step of conveying of the one sheet of recording paper to said printing position.

7. A method of printing, comprising the steps of:
housing recording paper that is in a pile of sheets;
picking up one sheet of recording paper and sending the sheet to a platen roller;
conveying the sent sheet of paper to a printing position which is between a thermal printing head and the platen roller by rotating the platen roller in a direction;
separating the one sheet of paper to be sent to the printing position from the rest of the paper in the pile by rotating a separation roller in the same direction as that of the platen roller;
sending back the other sheets away from the printing position by rotating the separation roller in a reverse direction; and
printing on the paper at the printing position with the thermal printing head.

8. A printer as set forth in claim 7, wherein said separation roller is disposed movable toward and away from said platen roller.

9. A printer as in claim 7, further comprising:
means for giving said separation roller a constant torque in the same direction as the direction of rotation of said platen roller during the separating and for rotating the separation roller in the reverse direction relative to the direction of rotation of the platen roller during the conveying of the one sheet of recording paper to said printing position.

10. A printer as in claim 7, further comprising means for biasing said separation roller in a direction against said platen roller.

11. A printer as in claim 7, wherein said printing head is arranged for pressing the paper on said platen roller between said printing head and said platen roller.

12. A printer as in claim 11, further comprising:

means for giving said separation roller a constant torque in the same direction as the direction of rotation of said platen roller during the separating and for rotating the separation roller in the reverse direction relative to the direction of rotation of the platen roller during the conveying of the one sheet of recording paper to said printing position.

* * * * *

UNITED STATES PATENT AND TRADEMARK OFFICE

CERTIFICATE OF CORRECTION

PATENT NO. : 5,052,836

DATED : October 1, 1991

INVENTOR(S) : HIROKAZU GENNO

It is certified that error appears in the above-identified patent and that said Letters Patent is hereby corrected as shown below:

Claims 1-6 at col. 4 lines 1-40 and claims 8-12 at col. 4 lines 58-68, col. 5 lines 1-8 and col. 6 lines 1-7 are cancelled in their entireties and substituted by the following:

18. A printer, comprising:

a printing head for printing on recording paper;

a platen roller supporting the recording paper;

housing means for housing the recording paper in a pile of sheets;

means for picking up one sheet of recording paper from the housing means and for sending the sheet to said platen roller;

means for rotating said platen roller in a direction for conveying the sent sheet of the recording paper to a It is certified that error appears in the above-identified patent and that said Letters Patent is hereby corrected as shown below:

printing position which is between said platen roller and said printing head; and a rotatable separation roller being positioned relative to said platen roller for enabling separation of the one sheet of the recording paper from the remaining sheets in the pile upon rotation of said separation roller in the same direction of rotation as that of said platen roller and for sending back the other sheets away from the printing position upon rotation of said separation roller in the reverse direction.

19. A printer as set forth in claim 18, wherein said separation roller is disposed movable toward and away from said platen roller.

It is certified that error appears in the above-identified patent and that said Letters Patent is hereby corrected as shown below:

20. A printer as in claim 18, further comprising:

means for giving said separation roller a constant torque in the same direction as the direction of rotation of said platen roller during the separating and for rotating the separation roller in the reverse direction relative to the direction of rotation of the platen roller during the conveying of the one sheet of recording paper to said printing position.

21. A printer as in claim 18, further comprising means for biasing said separation roller in a direction against said platen roller.

It is certified that error appears in the above-identified patent and that said Letters Patent is hereby corrected as shown below:

22. A printer as in claim 18, wherein said printing head is arranged for pressing the paper on said platen roller between said printing head and said platen roller.

23. A printer as in claim 22, further comprising:

means for giving said separation roller a constant torque in the same direction as the direction of rotation of said platen roller during the separating and for rotating the separation roller in the reverse direction relative to the direction of rotation of the platen roller during the conveying of the one sheet of recording paper to said printing position.

13. A method as in claim 7, further comprising the step of moving the separation roller toward and away from the platen roller.

It is certified that error appears in the above-identified patent and that said Letters Patent is hereby corrected as shown below:

14. A method as in claim 7, further comprising the step of giving the separation roller a constant torque in the same direction as the direction of rotation of said platen roller during the step of separating and rotating the separation roller in the reverse direction relative to the direction of rotation of the platen roller during the step of conveying of the one sheet of recording paper to said printing position.

15. A method as in claim 7, further comprising the step of biasing the separation roller in a direction against said platen roller.

UNITED STATES PATENT AND TRADEMARK OFFICE

CERTIFICATE OF CORRECTION

PATENT NO. : 5,052,836

DATED : October 1, 1991

INVENTOR(S) : Hirokazu Genno

It is certified that error appears in the above-identified patent and that said Letters Patent is hereby corrected as shown below:

16. A method as in claim 7, further comprising pressing paper on said platen roller between said printing head and said platen roller.

17. A printer as in claim 16, further comprising the step of giving the separation roller a constant torque in the same direction as the direction of rotation of said platen roller during the step of separating and rotating the separation roller in the reverse direction relative to the direction of rotation of the platen roller during the step of conveying of the one sheet of recording paper to said printing position.

Signed and Sealed this

Twenty-fifth Day of October, 1994

*Attest:*

Bruce Lehman

BRUCE LEHMAN

*Attesting Officer*

*Commissioner of Patents and Trademarks*